United States Patent [19]

Meijer et al.

[11] 4,079,348

[45] Mar. 14, 1978

[54] THERMALLY RESPONSIVE ELECTRICAL SWITCH

[75] Inventors: Gerhardus Jan Meijer, Almelo; Jan van Rooyen, Borne, both of Netherlands

[73] Assignee: Texas Instruments Incorporated, Dallas, Tex.

[21] Appl. No.: 690,481

[22] Filed: May 27, 1976

[51] Int. Cl.[2] ..... H01H 37/52

[52] U.S. Cl. ..... 337/354; 337/372

[58] Field of Search ..... 337/346, 354, 365, 372, 337/375

[56] References Cited

U.S. PATENT DOCUMENTS

| | | | |
|---|---|---|---|
| 3,164,701 | 1/1965 | Kirchhubel | 337/375 |
| 3,317,693 | 5/1967 | Bolesky | 337/354 |
| 3,470,517 | 9/1969 | Ohlemacher et al. | 337/354 |
| 3,768,057 | 10/1973 | Sekira et al. | 337/375 |

*Primary Examiner*—Harold Broome

*Attorney, Agent, or Firm*—John A. Haug; James P. McAndrews

[57] ABSTRACT

A thermally responsive electrical switch has a contact arrangement mounted within an open-ended chamber in an electrically insulating switch body, the body having a rim around the open chamber end and having a shoulder formed in the rim which also extends around the open chamber end. A thermally conducting cap is secured over the open end of the chamber engaging the rim of the chamber and a snap-acting thermally responsive bimetal disc has its periphery disposed between the cap and the noted shoulder for positioning the disc relative to the contact arrangement. A motion transfer pin is movable in response to snap-acting movement of the thermally-responsive disc to move the contact arrangement between open and closed circuit positions during temperature changes. The body has slots in the rim of the chamber extending through the body shoulder and a guide has a passage slidably receiving and guiding movement of the transfer pin, the guide also having peripherally extending mounting portions fitted into the body slots and secured therein by the cap for mounting and locating the guide relative to the contact arrangement.

4 Claims, 2 Drawing Figures

THERMALLY RESPONSIVE ELECTRICAL SWITCH

Figure 1:
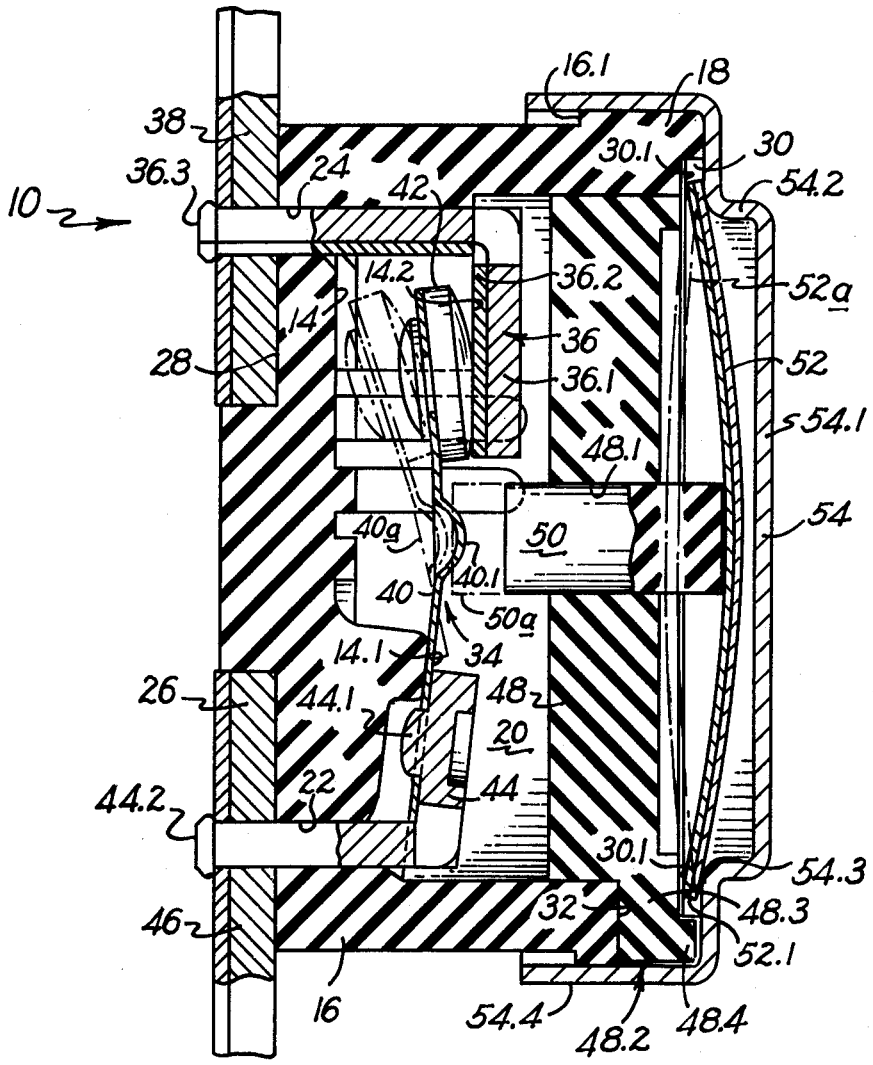

A thermally responsive electrical switch of a known type has a contact arrangement mounted on an open ended chamber in an electrically insulating switch body. A thermally conducting cap is secured over the open end of the switch chamber for holding a snap-acting bimetal member in a position where it is electrically and physically separated from the contact arrangement but where it is also rapidly responsive to ambient temperature changes by heat transfer through the thermally conducting cap. A motion transfer pin is mounted for movement to transfer snap-acting motion of the bimetal member to the contact arrangement for opening and closing the switch. While such known switches have been widely used for their excellent thermal response properties and for their long service lives, it has been found that, when attempts have been made to reduce switch manufacturing costs while assuring proper guiding of the motion transfer pin, difficulties encountered in assembling the switches have led to undesirably high rejection rates so that full manufacturing cost savings have not been realized.

It is an object of this invention to provide a novel and improved thermally-responsive electrical switch; to provide such a switch in which the thermally responsive component is physically and electrically separated from the switch contacts while also being positioned to be rapidly responsive to variations in ambient temperature; to provide such a switch which utilizes inexpensive switch components; and to provide such a switch which is easily and accurately assembled.

Briefly described, the novel and improved thermally responsive switch of this invention comprises a switch body of electrical insulating material having a body recess with a bottom, a side wall, and a rim defining an open-ended, cup-shaped switch chamber. A shoulder on the body at the rim of the body recess extends circumferentially around the open chamber end. The body also has a plurality of slots spaced around the open chamber end extending into the rim of the body recess and into the shoulder formed in the rim. Because of the simple cup shape of the switch body recess, the body is easily and inexpensively formed by molding or the like. However, because the bottom rim, shoulder and slots of the body recess are formed in a common switch component, these important locating features of the switch are easily positioned with precision relative to each other. A contact arrangement is mounted on the switch body, preferably on the recess bottom, for movement between open and closed circuit positions. A guide member having a guide passage therein has peripherally extending mounting portions fitted into the body slots locating the guide to slidably receive and guide a motion transfer pin in the guide passage for movement relative to the contact arrangement. Because of the simple structure of the guide member, the member is easily formed by molding and is easily and accurately assembled with the switch body without interferring with mounting of other switch components. A thermally conducting cap having a circumferential shoulder adjacent the open cap end is fitted over the open end of the switch body chamber with the cap shoulder engaging the rim of the body recess and a thermally responsive snap-acting bimetal element has its periphery disposed between the cap and the shoulder on the switch body for positioning the element relative to the motion transfer pin so that snap-acting movement of the bimetal element in response to temperature change is transferred through the pin to the contact arrangement for open and closing the switch circuit. The engagement of the cap with the rim of the body recess precisely locates the cap relative to the contact arrangement mounted on the body and relative to the shoulder which cooperates with the cap in locating the bimetal element. The cap also secures the guide member within the switch chamber, this mounting of the guide assuring that variations in guide member thickness do not adversely affect positioning of the bimetal element.

Figure 2:
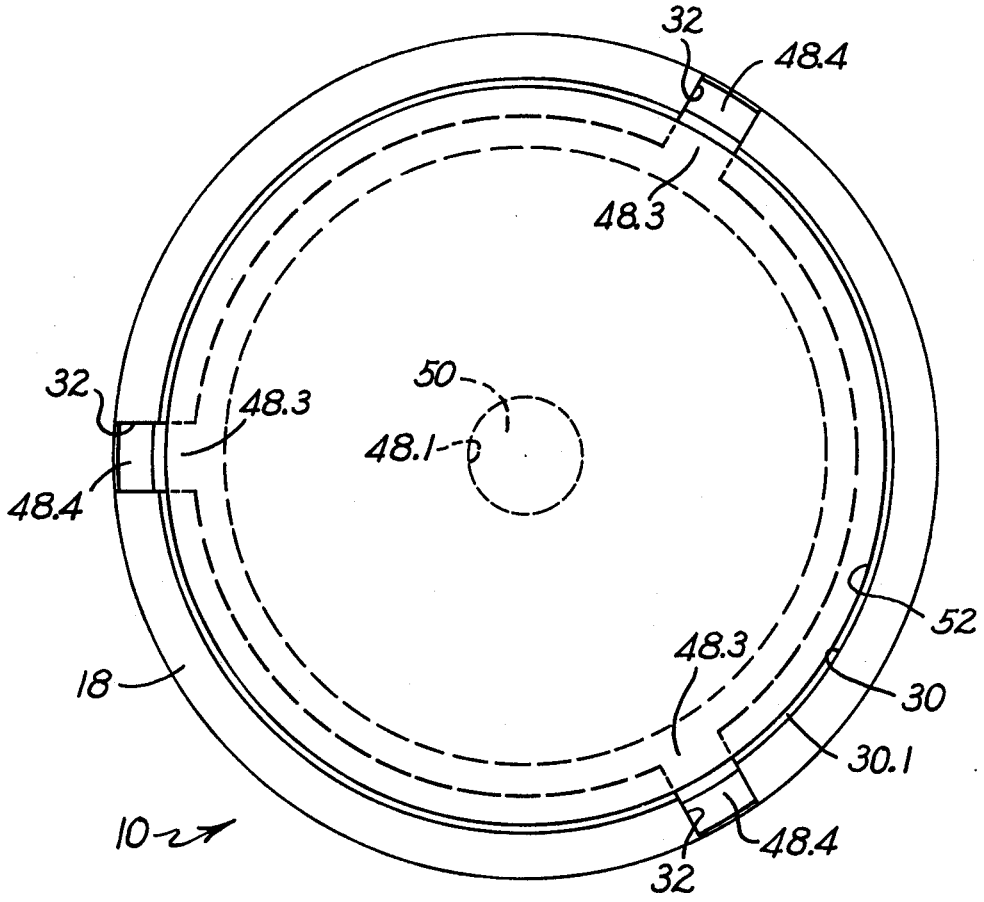

Other objects, advantages and details of the novel and improved switch of this invention appear in the following detailed description of preferred embodiments of the invention, the detailed description referring to the drawings in which:

FIG. 1 is a section view along the vertical axis of the switch of this invention; and FIG. 2 is a bottom plan view of the switch of FIG. 1 illustrating the switch with the switch cap removed.

Referring to the drawings, 10 in FIGS. 1 and 2 indicates the novel and improved thermally-responsive electrical switch of this invention which is shown to include a support or body 12 of an electrically insulating material such as a phenolic resin. As illustrated, the switch body 12 has a recess therein which has a bottom 14, a side wall 16, and a recess rim 18 defining an open-ended, cup-shaped switch chamber 20, the recess bottom preferably having a pair of apertures 22 and 24 therein communicating between the switch chamber and respective grooves 26 and 28 formed on the exterior of the switch body. In accordance with this invention, the switch body has a groove 30 in the recess rim forming a shoulder 30.1 which extends circumferentially around the open end of the switch chamber 20 and which is spaced closely adjacent to the edge of the recess rim 18. Further, a plurality of slots 32 are formed in the recess rim equally spaced around the open end of the chamber as is shown particularly in FIG. 2, these slots each extending into the recess rim 18 and extending to a selected depth through the recess shoulder 30.1 into the recess side wall 16 as is shown particularly in FIG. 1.

A contact arrangement 34 is mounted on the switch body 12, preferably on the bottom 14 of the body recess, so that a movable contact means is movable between open and closed circuit positions and is normally biased to one of said circuit positions. Typically for example, the contact arrangement 34 includes a fixed L-shaped contact arm 36 which is formed of a layer 36.1 of brass bonded to a layer 36.2 of silver and which has a portion of the arm fitted into the body aperture 24 and through an opening in a multilayer metal terminal 38, the arm being headed over as indicated at 36.3 for clamping the terminal 38 in the body groove 28. The typical contact arrangement also includes a movable contact arm 40 of a resilient, electrically conductive material having an electrical contact 42 carried at one end of the movable arm, the movable arm having a dimpled, force-transfer area 40.1 intermediate the arm ends and having its opposite end secured to movable contact arm support 44. The support 44 is preferably riveted to the movable arm 40 as indicated at 44.1 so that the arm extends in cantilever relation from the support with the movable contact resiliently biased into a closed circuit position engaging its complementary contact arm 36. The opposite end of the support 44 extends through aperture 22 in the switch body and through an aperture in the multilayer terminal 46 and is headed over as indicated at 44.2 for clamping the terminal 46 in the body groove 26. As illustrated in FIG. 1, the fixed contact arm 36 and the movable arm 40 preferably engage reference body surfaces 14.1 and 14.2 respectively (which can be considered as part of the bottom of the switch body recess) for accurately locating the contact arrangement relative to the switch body. As such a typical contact arrangement is shown, for example, in U.S. Pat. No. 3,410,115, the contact arrangement 34 is not otherwise described herein.

In accordance with this invention, a guide number 48, also preferably molded of a phenolic resin or the like is provided with a central guide passage 48.1 and with a plurality of peripherally extending mounting portions 48.2 each of which includes a relatively thin extending part 48.3 and an end part 48.4 upstanding from the outer edge of the extending part. The mounting portions of the guide member are disposed in respective slots 32 in the switch body so that the extending part 48.3 of each guide mounting portion fits beneath the level of the body shoulder 30.1 and so that the end part 48.4 of each guide mounting portion preferably fits substantially flush with the outer edge of the body chamber rim 18 as shown in FIG. 1.

A motion transfer pin 50, preferably of a rigid ceramic material or the like is slidably positioned within the guide passage 48.1. A thermally-responsive bimetal member or element 52 of a dished configuration is then mounted at the open end of the switch chamber 20 as shown in FIG. 1 and a cap 54 of a thermally conductive metal or the like is fitted over the open end of the body chamber. The cap 54 is cup shaped, has a bottom 54.1, a side wall 54.2 and a shoulder 54.3 adjacent the open-end of the cap, and has a rim part 54.4. As shown the cap rim is fitted losely around the rim 18 of the switch body recess for frictionally securing the cap to the body and the cap shoulder is engaged with the body rim 18, whereby the cap is precisely located relative to the contact arrangement 34 and to the shoulder 30.1 at the open end of the body recess 20. In this arrangement, the periphery 52.1 of the bimetal element is disposed between the body shoulder 30.1 and the shoulder part 54.3 of the cap for locating the bimetal element 52 relative to the transfer pin 50. If desired the side wall 16 of the body recess is stepped as indicated at 16.1 and the cap rim 54.4 extends over the wall step, whereby the cap rim can be swaged slightly over the wall step for firmly securing the cap to the body. As will be understood, the thermally responsive bimetal element 52 is of conventional type having an original dished configuration as indicated in FIG. 1, the element being adapted to move with snap-action to an inverted dished configuration when the element is heated to a selected temperature and to return to its original configuration with snap action when the element is subsequently cooled to a degree below said selected temperature.

In operation of the switch 10, the bias of the movable contact arm 40 normally holds the contact 42 in engagement with the contact arm 36 to close a switch circuit between terminals 38 and 46 while the bimetal element 52 is in the position shown in FIG. 1. However, on heating of the bimetal element to said selected temperature so that the element moves with snap action to the position shown by broken lines **52*a* in FIG. 1, the pin 50 moves to the position shown by broken lines 50*a* in response to movement of the bimetal element to engage the force area 40.1 of the movable contact arm 40, thereby to move the contact arm to the position indicated by broken lines 40*a* to open the switch circuit. On subsequent cooling of the bimetal element 52 so that the element snaps back to the configuration shown in FIG. 1, the bias of the contact arm 40 recloses the switch circuit and moves the transfer pin 50 back to the position shown in solid lines in FIG. 1**.

In this switch structure, the rim 18 of the body recess and the shoulder 30.1 are positively located relative to the body surfaces 14.1 and 14.2 which locate the contact arrangement 34 on the switch body. That is, the noted body surfaces are located at the same side of the insulating switch body for facilitating accurate location relative to each other. Therefore, the cap 54 cooperates with the body rim and shoulder to accurately locate the bimetal element 52 relative to the contact arrangement. The extending parts 48.3 of the guide member mounting portions fit beneath the level of the body shoulder 30.1 and therefore do not interfere with accurate positioning of the bimetal element even though there may be variations in the thickness of the guide member. The end parts of the guide member mounting portions are substantially flush with the body rim 18 so that the metal cap holds the guide member in its mounting slots 32 and the rim of the metal cap fits over the slots 32 to effectively close these slots. Thus, the switch body and guide member are easily manufactured but are also easily and accurately assembled with the contact arrangement 34, the pin 50, the bimetal 52, and the cap 54 to provide a low cost and reliable thermally responsive switch.

It will be understood that various modifications of the described embodiment of the switch of this invention are possible within the scope of this invention and that the invention includes all modifications and equivalents thereof following within the scope of the appended claims.

We claim:

1. A thermally responsive electrical switch comprising an electrically insulating switch body having an open-ended switch chamber therein, having a rim around the open end of the chamber, and having a shoulder formed in the rim extending circumferentially around the open chamber end, the body having slots around the open chamber end extending into the body rim through the shoulder, a contact arrangement mounted on the body within the chamber including contact means movable between open and closed circuit positions, a guide having a guide passage and having peripherally extending mounting portions fitted into respective body slots locating the guide passage relative to said contact means, an open-ended cup-shaped cap of thermally conductive material having a circumferential shoulder adjacent the open cup end engaging the body rim for locating the cap relative to said contact means on the body and having a cap rim fitted around the body rim securing the cap to the body, a pin slidable in the guide passage to move the contact means between said circuit positions, and a thermally responsive bimetal member of a dished configuration movable with snap-action to an inverted dished configuration in response to selected temperature change, the bimetal member having its periphery located between the cap and said body shoulder for sliding the pin in the guide passage to move said contact means in response to said snap-acting movement of the bimetal member.

2. A thermally responsive electrical switch comprising a switch body of electrical insulating material having a recess with a bottom, a side wall and a rim defining an open-ended switch chamber, the body having a groove in the recess rim forming a shoulder extending circumferentially around the open end of the chamber and having a plurality of slots spaced around the open chamber end extending through the rim and shoulder into the recess side wall, first contact means mounted on the body within the chamber, second contact means mounted on the body within the chamber for movement between open and closed circuit positions relative to the first contact means, the second contact means being biased to one of said circuit positions, a guide disc member having a guide passage and having peripherally extending mounting portions fitted into respective body slots for locating the guide passage relative to the second contact means, an open-ended cup-shaped cap of thermally conductive metal material having a circumferential shoulder adjacent the open end of the cap engaging the body rim for locating the cap relative to the second contact means and for retaining the guide member mounting portions in said slots and having a cap rim fitted around the body rim securing the cap to the body, a motion transfer pin slidable in the guide passage to move the second contact means to said other circuit position against said bias, and a thermally responsive bimetal member of a dished configuration movable with snap-action to an inverted dished configuration in response to a selected temperature change, the bimetal member having its periphery located between the cap and said body shoulder for positioning the bimetal member to slide the transfer pin in response to said snap-acting movement of the bimetal member.

3. A thermally responsive switch as set forth in claim 2 wherein each of said guide mounting portions has a first part extending through a slot in said recess wall and a second part upstanding from said first part to be flush with said body rim outside said shoulder, whereby the cap limits movement of the guide member mounting portions in said slots for firmly positioning the guide member relative to the switch body.

4. A thermally responsive switch as set forth in claim 3 wherein said first and second contact means are mounted on said recess bottom in precisely spaced relation to said body rim and shoulder and have terminal portions thereof extending through said recess bottom.

* * * * *